US006219865B1

(12) United States Patent
Stokesbary

(10) Patent No.: US 6,219,865 B1
(45) Date of Patent: Apr. 24, 2001

(54) HEAD SUPPORT

(76) Inventor: Carla R. Stokesbary, 3630 Barbary Ave., Cincinnati, OH (US) 45207

( * ) Notice: Subject to any disclaimer, the term of this patent is extended or adjusted under 35 U.S.C. 154(b) by 0 days.

(21) Appl. No.: 09/539,534

(22) Filed: Mar. 31, 2000

Related U.S. Application Data

(60) Provisional application No. 60/127,800, filed on Apr. 2, 1999.

(51) Int. Cl.[7] ..... A47C 20/00

(52) U.S. Cl. ..... 5/637; 5/640; 5/636; 4/523; 297/392

(58) Field of Search ..... 5/636, 637, 640; 297/392, 397; 4/523

(56) References Cited

U.S. PATENT DOCUMENTS

| | | | | |
|---|---|---|---|---|
| 2,088,207 | * | 7/1937 | Kaiser | 297/392 |
| 2,284,058 | * | 5/1942 | Kaiser et al. | 297/392 |
| 2,774,601 | * | 12/1956 | White | 297/392 X |
| 4,617,691 | * | 10/1986 | Monti et al. | 5/640 |

* cited by examiner

*Primary Examiner*—Michael F. Trettel
(74) *Attorney, Agent, or Firm*—Neal O. Willmann

(57) ABSTRACT

This disclosure relates to a head support that is comfortably resilient and adjustable to fit around the neck and under the lower jaw of the wearer to support the head in a generally erect posture enabling the wearer to relax, and perhaps sleep, while stabilizing the head to permit, for example, coiffuring and drying the hair without active participation or attentiveness on the part of the wearer.

4 Claims, 1 Drawing Sheet

HEAD SUPPORT

This application claims the benefit of U.S. Provisional Application 60/127,800 filed Apr. 2, 1999.

BACKGROUND OF THE INVENTION

This disclosure relates in a general way to the use of pillows and pads for supporting the head in an erect position while the wearer is in an upright, erect sitting position. But more particularly the disclosure relates to a novel head support that is designed to be positioned around the neck and under the jaw and chin of the head. Such a structure worn around the neck and resting upon the chest of the wearer and positioned directly under the chin and lower jaw can comfortably support the head and allow the wearer to relax her neck and shoulder muscles while supporting the head in an erect alignment with the rest of the body.

DESCRIPTION OF THE PRIOR ART

There is no shortage of relevant prior art in the patent literature. For instance, U.S. Pat. No. 4,285,081, which issued to Price on Aug. 25, 1981, describes a device to facilitate the recumbency of the head and neck by providing gentle pressure on or near the general vicinity of the mastoid processes of the head. Then there is a series of design patents including Des. 348,174; Des. 316,7893; and Des. 363,631; all of which appear to support the head by supporting the base or rear of the skull while the wearer is seated in a reclining position. But, notwithstanding all the pads, pillows and supports that have been disclosed, there remains a need for a head support that is designed to maintain the head comfortably in an erect position while the wearer assumes an upright, seated position. This need is addressed and met by the head support described herein and which can be fairly characterized as follows:

SUMMARY OF THE INVENTION

Disclosed herein is a head support to be worn below the head, under the jaw and chin, and around the neck, said support comprising: a padded wedge to be positioned between the wearer's lower jaw and clavicles and having a fastening means attached to said wedge for maintaining said wedge in said position thus orienting the wearer's head in a generally erect alignment while the wearer is seated.

DESCRIPTION OF THE PREFERRED EMBODIMENT

Figure 1:
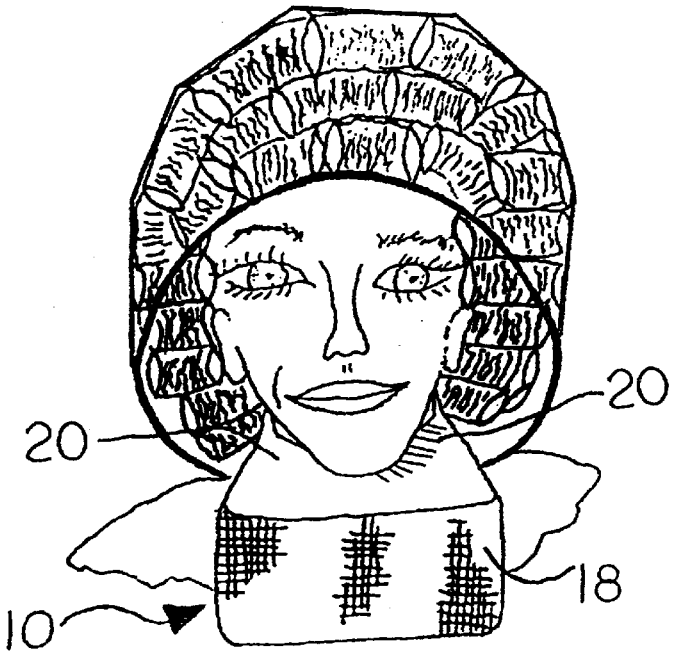
FIG. 1 is an elevated perspective view of the disclosed head support in use.

The head support disclosed and described herein can be best described by reference to the drawing. FIG. 1 is a depiction of the disclosed head support in use. It is clear that when used as intended, the head support 10 encircles the neck of the wearer and abuts the chin and lower jaw to support the head and maintain it in a generally erect position.

Figure 2:
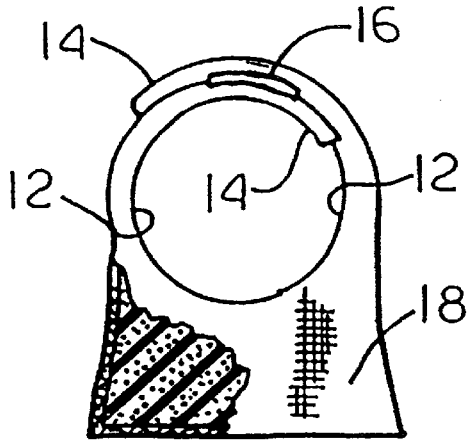
FIG. 2 is a top plan view of the disclosed head support in partial section to show the composition of the interior of the head support.
Figure 3:
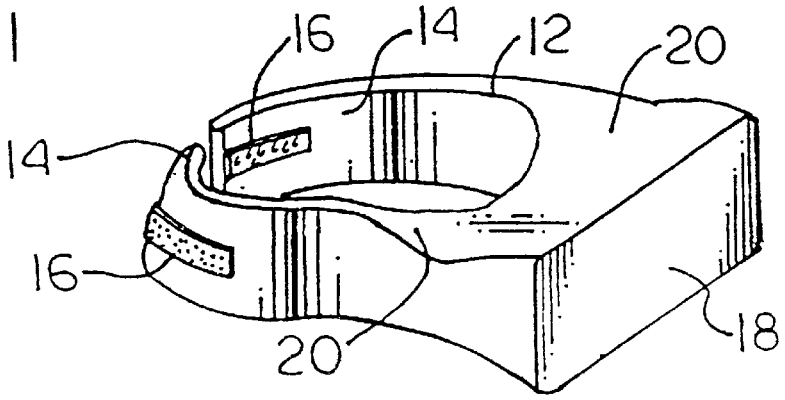
FIG. 3 is a raised perspective view of the head support.

In FIG. 2, it is apparent that the head support includes a collar 12 for encircling the neck. The collar is formed by the lower jaw support area 20 and the collar straps 14. The collar straps complete the encircling of the neck and provide a fastening means 16 for securing the head support 10 to the wearer so that it fits snugly, yet comfortably, and won't fall off if the wearer inadvertently alters her position or stretches her neck to improve circulation or comfort. Preferably, the collar straps 14 are radically tapered as they extend from the front to the back of the head. It is also envisioned that the straps 14 be more thinly padded than the larger wedge portion of the support 10. Clearly, while the straps 14 are intended primarily to hold the support in place around the neck of the wearer, it is also important that they be unobtrusive so that they not interfere with and remain out of the way of the rollers and rods that are frequently used by stylists in the coiffuring process. And it is the comfort and convenience of the salon client that the design of the disclosed support is intended to address primarily because, clearly, it is the patron of the coiffuring salons who will benefit the most from the use of the disclosed support 10.

Figure 4:
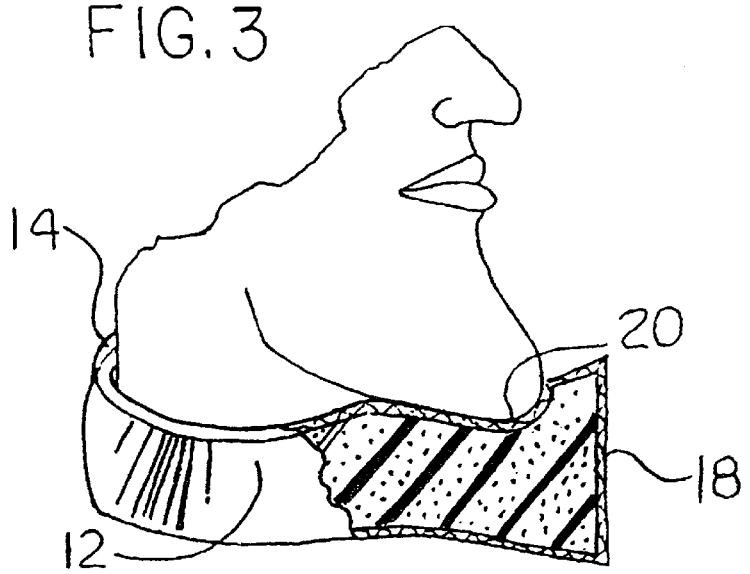
FIG. 4 is an elevated perspective view of the head support in use and in cross section to demonstrate the resilient nature of the support.

Also in FIG. 2, a partial section of the rest 10 has been removed to illustrate the foam-like composition of the support. This is further illustrated in FIG. 4 where the weight of the head can be seen causing the lower jaw support area 20 of the support to compress slightly. In a preferred embodiment, it is envisioned that the head support 10 will be made from an open-celled foam and covered or enveloped with a cloth or fabric material. The cloth covering would be removable to facilitate laundering and would ideally provide enhanced comfort to the wearer because it would not become as hot if, for instance, the wearer were to spend a prolonged period of time exposed to the heat of a hair dryer. The advantage of the foam construction, of course, is that it would be resilient and conformable, to a large extent, to the jaw and chin line of the wearer; and, at the same time, structurally supportive, should the wearer should fall asleep and place the full weight of her head on the upper surface of the wedge portion of the support 10.

In use, the rest 10 will be positioned so that the collar 12 encircles the neck of the wearer and is secured at the back of the neck by the fastening means 16. Typically, the fastening means can be pieces of Velcro hook and loop fastener attached to the inner and outer sides of the collar straps 14. Once the collar straps 14 are secure, the support 10 can be manually adjusted to assure a comfortable fit between the lower jaw and chin of the wearer and the lower jaw support area 20 of the support 10. It should also be noticed that the support, if positioned properly, will be necessarily large enough to hold the head in an erect orientation but not too large to cause the head to tilt toward the back.

While the foregoing is a complete and detailed description of the preferred embodiments of the disclosed head support, numerous variations and modifications may be employed to implement the all-important purpose of the support without departing from the spirit of this invention; and, therefore, the elaboration provided should not be assumed to limit, in any way, the scope of the invention, which is fairly defined by the appended claims.

What I claim is:

1. A head support to be worn below the head and around the neck, said support comprising: a resilient wedge, enveloped in a removable and washable cover, to be positioned between the wearer's lower jaw and clavicles and a fastening means attached to radically tapered collar straps extending from said wedge for maintaining said wedge in said position thus orienting the wearer's head in a generally erect alignment.

2. A head support according to claim 1 wherein said fastening means comprises a pair of collar straps.

3. A head support according to claim 2 wherein said collar straps further comprise a plurality of hook and loop strips.

4. A head support according to claim 1 wherein the resilient wedge is comprised of an open foam material.

* * * * *

UNITED STATES PATENT AND TRADEMARK OFFICE

CERTIFICATE OF CORRECTION

PATENT NO. : 6,219,865 B1
DATED : April 24, 2001
INVENTOR(S) : Carla R. Stokesbary It is certified that error appears in the above-identified patent and that said Letters Patent is hereby corrected as shown below:

Column 2,
Lines 60-67, claim 1 should read:

1. A head support to be worn below the head and around the neck, said support comprising: a resilient wedge, enveloped in a removable and/or washable cover, to be positioned between the wearer's lower jaw and clavicles and a fastening means attached to radically tapered collar straps extending from said wedge for maintaining said wedge in said position thus orienting the wearer's head in a generally erect alignment.

Signed and Sealed this

Fifth Day of August, 2003

JAMES E. ROGAN
*Director of the United States Patent and Trademark Office*